US011413219B2

(12) United States Patent
Li et al.

(10) Patent No.: US 11,413,219 B2
(45) Date of Patent: Aug. 16, 2022

(54) AUTOMATIC BREASTFEEDING METHOD OF PREMATURE INFANT AND AUTOMATIC BREASTFEEDING MACHINE

(71) Applicant: SHENZHEN KAIYANG INDUSTRIAL CO., LTD., Guangdong (CN)

(72) Inventors: Hongping Li, Guangdong (CN); Xinyong Chen, Guangdong (CN); Xikai Yang, Guangdong (CN); Yanan Lu, Guangdong (CN); Weimin Huang, Guangdong (CN)

(73) Assignee: SHENZHEN KAIYANG INDUSTRIAL CO., LTD., Shenzhen (CN)

( * ) Notice: Subject to any disclaimer, the term of this patent is extended or adjusted under 35 U.S.C. 154(b) by 437 days.

(21) Appl. No.: 16/610,830

(22) PCT Filed: Jan. 11, 2018

(86) PCT No.: PCT/CN2018/113541
§ 371 (c)(1),
(2) Date: Nov. 4, 2019

(87) PCT Pub. No.: WO2020/087478
PCT Pub. Date: May 7, 2020

(65) Prior Publication Data
US 2020/0253832 A1 Aug. 13, 2020

(51) Int. Cl.
*A61J 15/00* (2006.01)
*A61J 11/00* (2006.01)
*A61J 17/00* (2006.01)

(52) U.S. Cl.
CPC ..... *A61J 15/0076* (2015.05); *A61J 11/00* (2013.01); *A61J 15/0011* (2013.01); *A61J 15/0084* (2015.05); *A61J 17/001* (2015.05)

(58) Field of Classification Search
CPC ..... A61J 15/00; A61J 15/0011; A61J 15/003; A61J 15/0076; A61J 15/0084;
(Continued)

(56) References Cited

U.S. PATENT DOCUMENTS 6,129,703 A 10/2000 Beneke
2017/0202749 A1 7/2017 Koriat-Barkan

FOREIGN PATENT DOCUMENTS

CN 203647730 U 6/2014
CN 104546502 A 4/2015
(Continued)

*Primary Examiner* — Tiffany Legette

(57) ABSTRACT

An automatic breastfeeding method of a premature infant is disclosed, which includes a preparation stage, an active lactation stage, a passive lactation stage and a rest stage. The invention also provides an automatic breastfeeding machine used for the automatic breastfeeding method of a premature infant, comprising a stomach tube, a lactation supply device, a detector and a control device. According to the invention, a self-sucking ability of the premature infant is trained, normal circulation of a mouth-pharyngeal-gastric-intestinal reflex of the premature infant is realized, and nutritional requirements of the premature infant are ensured in the case of taking differences of the premature infants into account, so that the premature infants have no difference with term infants in care, diet, neurological development and growth and development in the future.

9 Claims, 3 Drawing Sheets

(58) Field of Classification Search
CPC ..... A61J 15/0003; A61J 15/0007; A61J 15/0015; A61J 15/0026; A61J 15/008; A61J 15/0088; A61M 1/06; A61M 1/062; A61M 1/064
See application file for complete search history.

(56) References Cited

FOREIGN PATENT DOCUMENTS

| | | | |
|---|---|---|---|
| CN | 205796074 | U | 12/2016 |
| CN | 109106602 | A | 1/2019 |
| CN | 109248097 | A | 1/2019 |

AUTOMATIC BREASTFEEDING METHOD OF PREMATURE INFANT AND AUTOMATIC BREASTFEEDING MACHINE

TECHNICAL FIELD

The present invention belongs to the field of medical device technologies, and more particularly, relates to an automatic breastfeeding method of a premature infant and an automatic breastfeeding machine.

BACKGROUND

The progress in current medical science and technology significantly improves a survival rate of premature infants. At present, the survival rate of premature infants with a birth weight of 1000 g to 2500 g has reached 85% to 95%, but the surviving premature infants are easy to suffer from growth retardation. The probability of growth retardation of premature infants with a birth weight less than 1500 g is as high as 50%, which not only affects the physical growth of the premature infants, but also greatly increases the possibility of long-term occurrence of metabolic disease, hypertension and neurological sequelae. It is related to the difficulty in establishing enteral nutrition for the premature infants after birth, and the difficulty in establishing enteral nutrition is related to the incomplete gastrointestinal tract development of the premature infants Meanwhile, due to the incomplete sucking and swallowing function of the premature infants, they cannot be fed orally for a long period of time after birth. A stomach tube is regularly used clinically, and a syringe is used by the nursing staff to inject lactation into the stomach to provide enteral nutrition. This method disrupts normal circulation of a mouth-pharyngeal-gastric-intestinal reflex of the body, further weakens the gastrointestinal digestion ability, and affects the nutritional absorption of the premature infants, thus causing the occurrence of growth retardation and leading to poor long-term prognosis.

The infants have the sucking ability when being about 20 weeks of gestational age, but the coordination of sucking and swallowing is realized when the infants are about 34 weeks of gestational age. Clinically, for the premature infants born within 34 weeks of pregnancy, in order to avoid the risk of lactation choking of the premature infants caused by direct feeding, lactation is fed by the stomach tube. Starting with a small amount of lactation according to clinical experience, the amount of lactation is increased slightly every day, and the infant is patted once every 2 h to 3 h regardless of whether the infant is sleeping or not, and the lactation is injected in about 1 min. This method does not take the individual differences of the premature infants into account, which easily leads to feeding intolerance of some premature infants, and this method completely deprives the premature infants of their sucking needs, which leads to the inability of premature infants to get training in self-sucking, and makes it difficult for premature infants to suck lactation at the later stage. As a result, the hospitalization time is prolonged, the hospitalization expenses are increased, and even the nervous system development is affected, thus causing great burden to family and society.

SUMMARY

The present invention is intended to overcome the defects in the prior art and provides an automatic breastfeeding method of a premature infant.

The present invention is realized as follows: an automatic breastfeeding method of a premature infant comprises the following steps of:

(1) a preparation stage: firstly, pre-storing lactation required for nutrition of the premature infant in a lactation supply device; arranging one end of a stomach tube in a stomach of the premature infant, and connecting the other end of the stomach tube with the lactation supply device; and then arranging a detector in a mouth of the premature infant, electrically connecting the detector with a control device, and electrically connecting the control device with the lactation supply device;

(2) an active lactation stage: when the premature infant sucks the detector, acquiring, by the detector, a sucking action of the premature infant, converting the sucking action into a sucking signal and transmitting the sucking signal to the control device, starting the lactation supply device after the control device receives the sucking signal, and stopping supplying lactation after the lactation supply device supplies a certain amount of lactation to the premature infant through the stomach tube;

when the premature infant sucks the detector again, acquiring, by the detector, a sucking action of the premature infant, converting the sucking action into a sucking signal and transmitting the sucking signal to the control device, starting the lactation supply device after the control device receives the sucking signal, and stopping supplying lactation after the lactation supply device supplies a certain amount of lactation to the premature infant through the stomach tube; and circulating in such manner until lactation in the lactation supply device is completely fed or the active lactation stage is ended;

(3) a passive lactation stage: when the lactation in the lactation supply device is completely fed in the step (2), transmitting a signal that the lactation is completely fed by the lactation supply device to the control device, and closing, by the control device, the lactation supply device, without performing passive lactation supply on the premature infant by the lactation supply device;

if residual lactation still exists in the lactation supply device after the active lactation stage is ended in the step (2), transmitting, by the lactation supply device, a signal that the residual lactation still exists to the control device, starting, by the control device, the lactation supply device to uniformly supply the residual lactation to the premature infant through the stomach tube until the lactation is completely fed, transmitting, by the lactation supply device, a signal that the lactation is completely fed to the control device, and closing, by the control device, the lactation supply device, without performing passive lactation supply on the premature infant by the lactation supply device; and (4) a rest stage: letting the premature infant rest until the rest stage is ended after the step (3) is finished.

Specifically, the amount of lactation required for nutrition of the premature infant pre-stored in the lactation supply device in the step (1) is 5 ml to 60 ml.

Specifically, the active lactation stage in the step (2) lasts for 10 min to 15 min.

Specifically, an amount of lactation supplied to the premature infant by the lactation supply device in the step (2) is 0.04 ml to 0.06 ml.

Specifically, the passive lactation stage in the step (3) lasts for 5 min to 10 min.

Specifically, a supplying speed of the lactation supply device in the step (3) is 0.4 ml/min to 2 ml/min.

Specifically, the rest stage in the step (4) lasts for 2 h to 3 h.

The present invention further provides an automatic breastfeeding machine used for the automatic breastfeeding method of a premature infant above, which comprises a lactation supply device and a stomach tube, wherein the lactation required for nutrition of the premature infant is stored in the lactation supply device, one end of the stomach tube is arranged in the stomach of the premature infant, the other end of the stomach tube is connected with the lactation supply device, the automatic breastfeeding machine further comprises a detector for detecting whether the premature infant has a sucking action and a control device, the detector is arranged in the mouth of the premature infant, the detector is electrically connected with the control device, and the control device is electrically connected with the lactation supply device.

Specifically, the lactation supply device comprises a shell, an installation groove is arranged in the shell, a propeller is fixedly arranged in the installation groove, the propeller comprises a sleeve for storing lactation, a piston, a pushing rod and a pushing plate, an injection head at a front end of the sleeve extends out of the shell and is connected with the stomach tube, the piston is slidably arranged in the sleeve, the piston is fixedly connected with a front end of the pushing rod, and a rear end of the pushing rod is fixedly connected with the pushing plate;

a distance sensing device is further arranged between a rear end of the piston and a rear end of the sleeve, the distance sensing device comprises a distance detection sensor and a reflecting plate, the reflecting plate is fixedly arranged on the piston, the distance detection sensor is fixedly arranged on the sleeve, and the distance detection sensor and the reflecting plate are electrically connected with the control device respectively;

the lactation supply device further comprises a motor, an output shaft of the motor is fixedly connected with a rear end of a screw through a shaft sleeve, a front end of the screw is sleeved with a screw sleeve, the screw is in threaded connection with the screw sleeve, and the screw sleeve is fixedly connected with the pushing plate; and the motor is electrically connected with a motor driver, and the motor driver is electrically connected with the control device.

Specifically, the detector comprises a suction nozzle and a pressure sensor arranged in the suction nozzle, and the pressure sensor is electrically connected with the control device.

The automatic breastfeeding method of a premature infant and the automatic breastfeeding machine according to the present invention have the following technical effects:

(1) in the active lactation stage, only when the premature infant sucks the detector, the pressure sensor of the detector acquires the sucking action of the premature infant and converts the sucking action into the sucking signal to be transmitted to the control device, and the control device starts the lactation supply device to supply lactation to the premature infant after receiving the sucking signal, so that a self-sucking ability of the premature infant is trained, and normal circulation of a mouth-pharyngeal-gastric-intestinal reflex of the premature infant is realized, thus enabling the premature infants to have no difference with term infants in care, diet, neurological development and growth and development in the future;

(2) after the active lactation stage of the premature infant is ended in the step (2), if the residual lactation exists in the lactation supply device, the passive lactation stage is performed, and in the passive lactation stage, the control device starts the lactation supply device to uniformly supply the residual lactation to the premature infant through the stomach tube, so that nutritional requirements of the premature infant are ensured in the case of taking differences of the premature infants into account; and (3) after the step (3) is finished, the rest stage is performed to enable the premature infant to have enough rest time, which is beneficial to the development of the premature infant.

BRIEF DESCRIPTION OF THE DRAWINGS

In order to more clearly illustrate the technical solutions of the present invention, the drawings to be used in the embodiments will be briefly introduced below. Obviously, the drawings in the following description merely indicate some embodiments of the present invention, and those ordinary skills in the art can further obtain other drawings according to the drawings without giving any creative work.

DETAILED DESCRIPTION

The technical solutions in the embodiments of the present invention are clearly and completely described below with reference to the drawings in the embodiments of the present invention.

Figure 1:
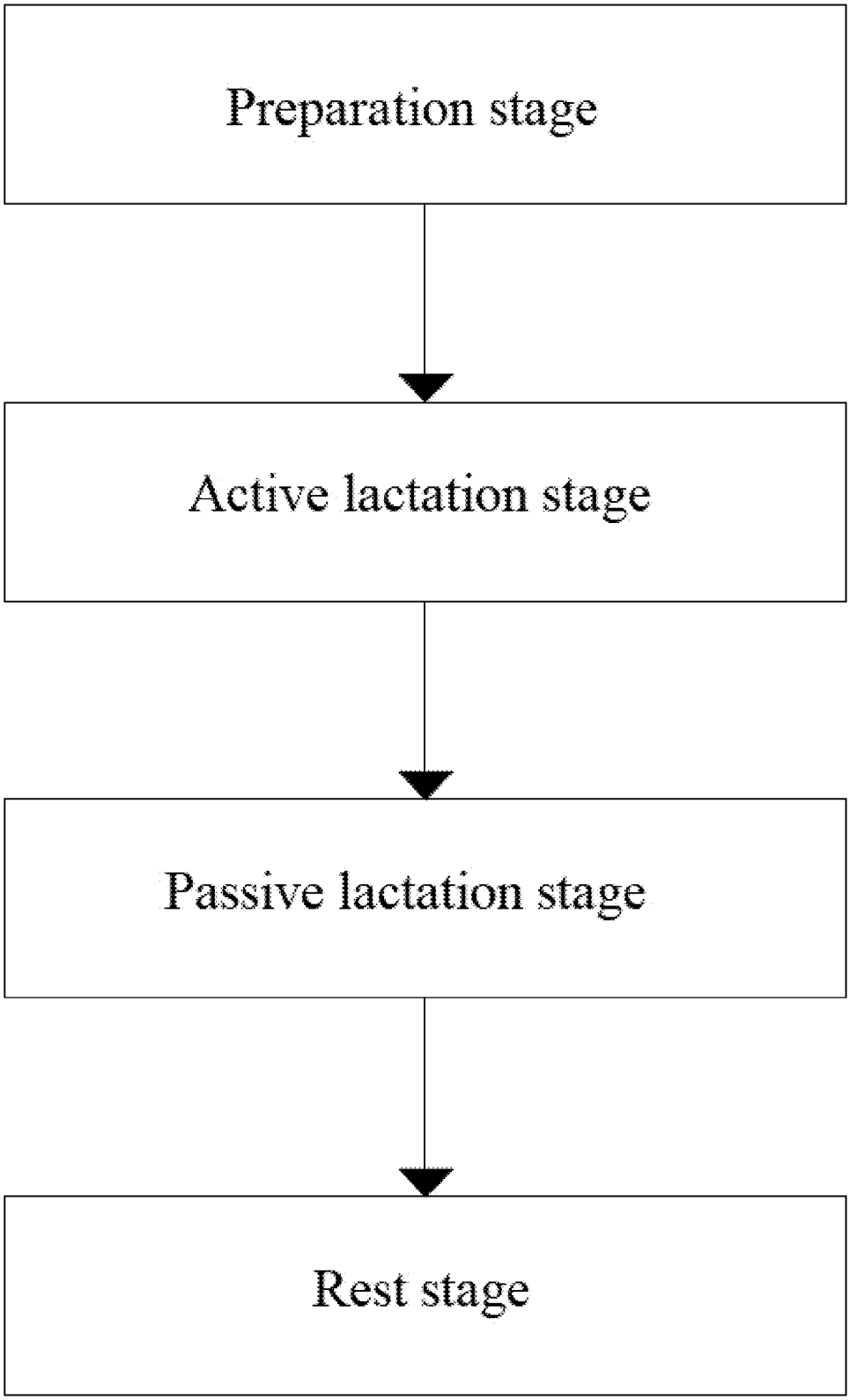
FIG. 1 is a step flow chart of an automatic breastfeeding method of a premature infant provided by an embodiment of the present invention.
Figure 2:
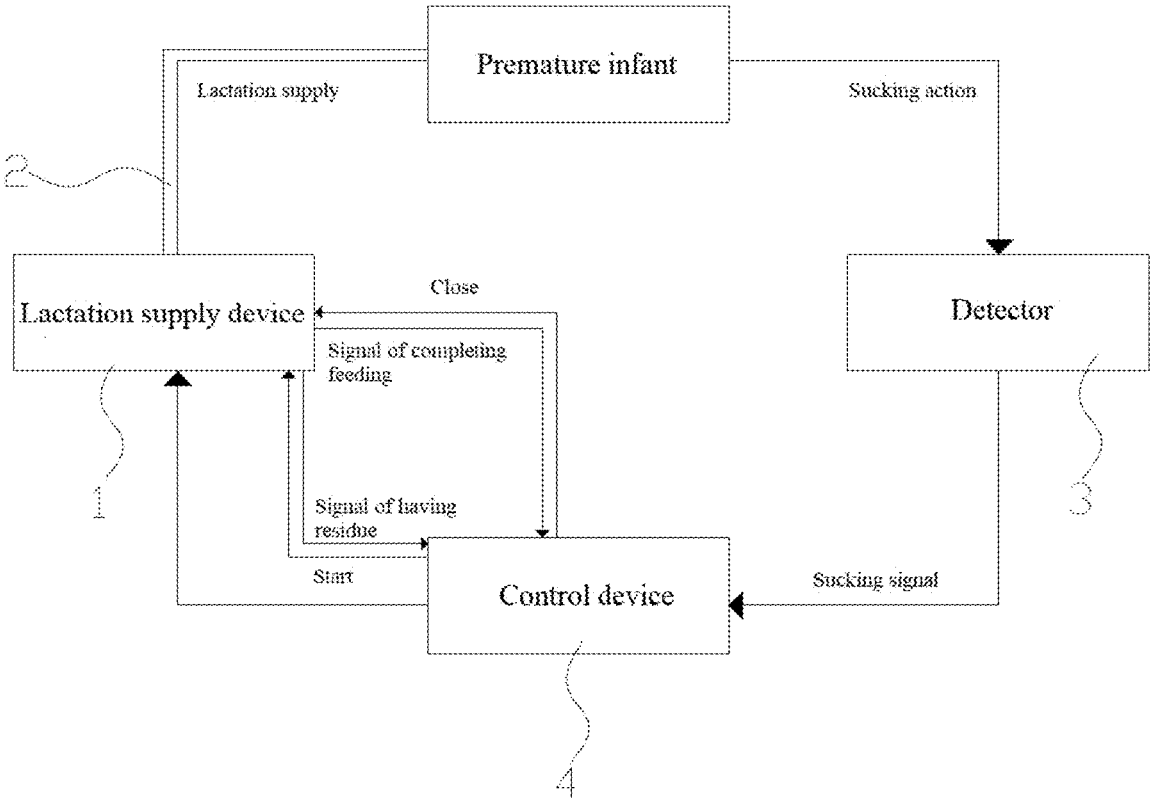
FIG. 2 is a schematic diagram of an automatic breastfeeding machine provided by an embodiment of the present invention.

As shown in FIG. 1 and FIG. 2, an embodiment of the present invention provides an automatic breastfeeding method of a premature infant, which comprises the following steps.

(1) In a preparation stage, lactation required for nutrition of the premature infant is firstly pre-stored in a lactation supply device 1, and an amount of lactation required for nutrition is 5 ml to 60 ml; one end of a stomach tube 2 is arranged in a stomach of the premature infant, and the other end of the stomach tube 2 is connected with the lactation supply device 1; and a detector 3 is then arranged in a mouth of the premature infant, the detector 3 is electrically connected with a control device 4, and the control device 4 is electrically connected with the lactation supply device 1.

(2) In an active lactation stage, when the premature infant sucks the detector 3, a sucking action of the premature infant is acquired by the detector 3 and converted into a sucking signal, the sucking signal is transmitted to the control device 4, the lactation supply device 1 is started after the control device 4 receives the sucking signal, and lactation supply is stopped after the lactation supply device 1 supplies a certain amount of lactation to the premature infant through the stomach tube 2;

when the premature infant sucks the detector 3 again, a sucking action of the premature infant is acquired by the detector 3 and converted into a sucking signal, the sucking signal is transmitted to the control device 4, the lactation supply device 1 is started after the control device 4 receives the sucking signal, and lactation supply is stopped after the lactation supply device 1 supplies a certain amount of lactation to the premature infant through the stomach tube 2; and circulation is performed in such manner until lactation in the lactation supply device 1 is completely fed or the active lactation stage is ended, an amount of lactation supplied to the premature infant by the lactation supply device 1 each time is 0.04 ml to 0.06 ml, and the active lactation stage lasts for 10 min to 15 min.

(3) In a passive lactation stage, when the lactation in the lactation supply device 1 is completely fed in the step (2), a signal that the lactation is completely fed is transmitted by the lactation supply device 1 to the control device 4, and the lactation supply device 1 is closed by the control device 4, without performing passive lactation supply on the premature infant by the lactation supply device 1; and if residual lactation still exists in the lactation supply device 1 after the active lactation stage is ended in the step (2), a signal that the residual lactation still exists is transmitted by the lactation supply device 1 to the control device 4, the lactation supply device 1 is started by the control device 4 to uniformly supply the residual lactation to the premature infant through the stomach tube 2 until the lactation is completely fed, a signal that the lactation is completely fed is transmitted by the lactation supply device 1 to the control device 4, the lactation supply device 1 is closed by the control device 4, without performing passive lactation supply on the premature infant by the lactation supply device 1, a supplying speed of the lactation supply device 1 is 0.4 ml/min to 2 ml/min, and the passive lactation stage lasts for 5 min to 10 min.

(4) In a rest stage, the premature infant shall have a rest until the rest stage is ended after the step (3) is finished, and the rest stage lasts for 2 h to 3 h.

An embodiment of the present invention further provides an automatic breastfeeding machine used for the automatic breastfeeding method of a premature infant above, which comprises a lactation supply device 1 and a stomach tube 2, wherein the lactation required for nutrition of the premature infant is stored in the lactation supply device 1, one end of the stomach tube 2 is arranged in the stomach of the premature infant, the other end of the stomach tube 2 is connected with the lactation supply device 1, the automatic breastfeeding machine further comprises a detector 3 for detecting whether the premature infant has a sucking action and a control device 4, the detector 3 is arranged in the mouth of the premature infant, the detector 3 is electrically connected with the control device 4, and the control device 4 is electrically connected with the lactation supply device 1.

Figure 3:
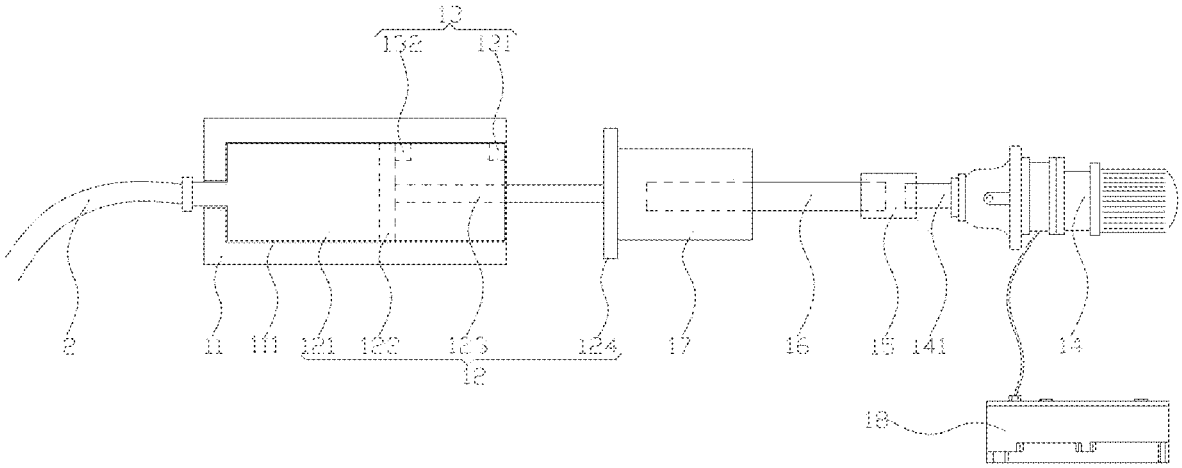
FIG. 3 is a structure diagram of a lactation supply device in FIG. 2.

As shown in FIG. 3, specifically, the lactation supply device 1 comprises a shell 11, an installation groove 111 is arranged in the shell 11, a propeller 12 is fixedly arranged in the installation groove 111, the propeller 12 comprises a sleeve 121 for storing lactation, a piston 122, a pushing rod 123 and a pushing plate 124, an injection head at a front end of the sleeve 121 extends out of the shell 11 and is connected with the stomach tube 2, the piston 122 is slidably arranged in the sleeve 121, the piston 122 is fixedly connected with a front end of the pushing rod 123, and a rear end of the pushing rod 123 is fixedly connected with the pushing plate 124.

A distance sensing device 13 is further arranged between a rear end of the piston 122 and a rear end of the sleeve 121, the distance sensing device 13 comprises a distance detection sensor 131 and a reflecting plate 132, the distance detection sensor 131 is preferably an infrared distance measuring sensor, the reflecting plate 132 is fixedly arranged on the piston 122, the distance detection sensor 131 is fixedly arranged on the sleeve 121, the distance detection sensor 131 and the reflecting plate 132 are electrically connected with the control device 4 respectively, and a displacement distance of the piston 122 is detected by the distance sensing device 13 to confirm a residual amount of lactation in the sleeve 121. For example, a total length of the sleeve 121 is 12 cm, a thickness of the piston 122 is 1 cm, a maximum movable distance between the rear end of the sleeve 121 and the rear end of the piston 122 is 11 cm, when a distance between the distance detection sensor 131 and the reflecting plate 132 reaches a maximum distance of 11 cm, the lactation in the lactation supply device 1 is proved to be completely fed, and a signal that the lactation is completely fed is transmitted by the distance detection sensor 131 to the control device 4; and when the distance between the distance detection sensor 131 and the reflecting plate 132 does not reach the maximum distance of 11 cm, residual lactation is proved to be still exist in the lactation supply device 1, and a signal that the residual lactation still exists is transmitted by the distance detection sensor 131 to the control device 4.

The lactation supply device 1 further comprises a motor 14, an output shaft 141 of the motor 14 is fixedly connected with a rear end of a screw 16 through a shaft sleeve 15, a front end of the screw 16 is sleeved with a screw sleeve 17, the screw 16 is in threaded connection with the screw sleeve 17, and the screw sleeve 17 is fixedly connected with the pushing plate 124.

The motor 14 is electrically connected with a motor driver 18, and the motor driver 18 is electrically connected with the control device 4.

Figure 4:
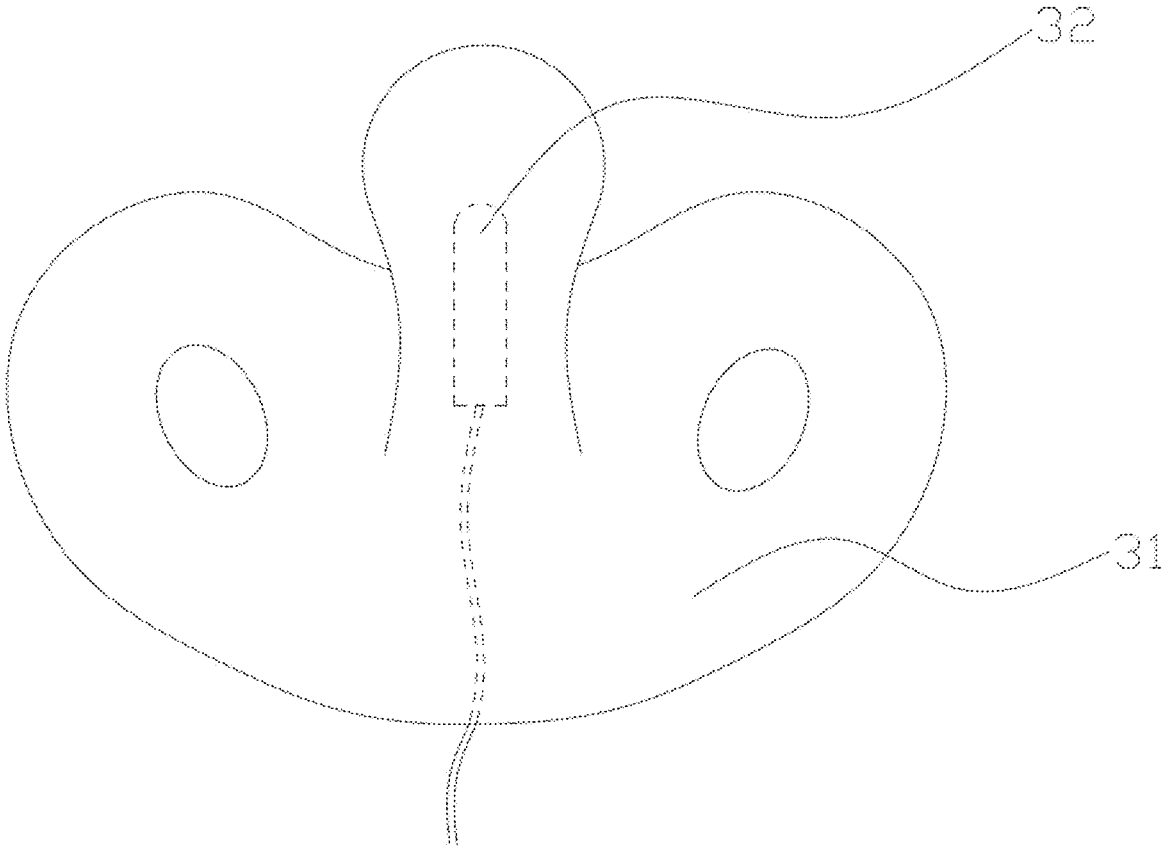
FIG. 4 is a structure diagram of a detector in FIG. 2.

As shown in FIG. 4, specifically, the detector 3 comprises a suction nozzle 31 and a pressure sensor 32 arranged in the suction nozzle 31, the pressure sensor 32 is electrically connected with the control device 4, the pressure sensor 32 is used for sensing a change of pressure information in the suction nozzle 31 caused by the sucking action of the premature infant, the pressure sensor 32 converts the change of pressure information into a sucking signal and transmits the sucking signal to the control device 4.

Preferably, the control device 4 is a microcontroller or a sequence controller.

The working principle of the automatic breastfeeding machine according to the present invention is as follows. Firstly, the automatic breastfeeding machine is started, in the active lactation stage of the step (2), when the premature infant sucks the detector 3, the sucking action of the premature infant applies a pressure to the suction nozzle 31 of the detector 3 to deform the suction nozzle 31, the pressure sensor 32 senses the change of pressure information in the suction nozzle 31 through the deformation of the suction nozzle 31, and the pressure sensor 32 converts the change of pressure information caused by the sucking action into the sucking signal and transmits the sucking signal to the control device 4.

Then, the control device 4 starts the motor driver 18 in the lactation supply device 1 after receiving the sucking signal, the motor driver 18 drives the output shaft 141 of the motor 14 to rotate clockwise, the output shaft 141 of the motor 14 drives the screw 16 to rotate clockwise through the shaft sleeve 15, the screw sleeve 17 at the front end of the screw 16 can move linearly and leftward due to the clockwise rotation of the screw 16, so that the screw sleeve 17 pushes the pushing plate 124 to move linearly and leftward, the pushing plate 124 drives the pushing rod 123 to move linearly and leftward, the pushing rod 123 drives the piston 122 to move linearly and leftward in the sleeve 121, the piston 122 drives the reflecting plate 132 to move linearly and leftward in the sleeve 121, the piston 122 pushes a certain amount of lactation into the stomach tube 2 from the sleeve 121, and then the lactation is fed to the premature infant through the stomach tube 2.

When the premature infant sucks the detector 3 again, the sucking action of the premature infant applies a pressure to the suction nozzle 31 of the detector 3 to deform the suction nozzle 31, the pressure sensor 32 senses a change of pressure information in the suction nozzle 31 through the deformation of the suction nozzle 31, and the pressure sensor 32 converts the change of pressure information caused by the sucking action into a sucking signal and transmits the sucking signal to the control device 4.

Then, the control device 4 starts the motor driver 18 in the lactation supply device 1 after receiving the sucking signal, the motor driver 18 drives the output shaft 141 of the motor 14 to rotate clockwise, the output shaft 141 of the motor 14 drives the screw 16 to rotate clockwise through the shaft sleeve 15, the screw sleeve 17 at the front end of the screw 16 can move linearly and leftward due to the clockwise rotation of the screw 16, so that the screw sleeve 17 pushes the pushing plate 124 to move linearly and leftward, the pushing plate 124 drives the pushing rod 123 to move linearly and leftward, the pushing rod 123 drives the piston 122 to move linearly and leftward in the sleeve 121, the piston 122 drives the reflecting plate 132 to move linearly and leftward in the sleeve 121, the piston 122 pushes a certain amount of lactation into the stomach tube 2 from the sleeve 121, and then the lactation is fed to the premature infant through the stomach tube 2.

Circulation is performed in such manner until lactation in the lactation supply device 1 is completely fed or the active lactation stage is ended.

Next, in the passive lactation stage, when the lactation in the lactation supply device 1 is completely fed in the step (2), the signal that the lactation is completely fed is transmitted by the distance detection sensor 131 in the lactation supply device 1 to the control device 4, and the lactation supply device 1 is closed by the control device 4, without performing passive lactation supply on the premature infant by the lactation supply device 1.

If residual lactation still exists in the sleeve 121 of the lactation supply device 1 after the active lactation stage is ended in the step (2), the signal that the residual lactation still exists is transmitted by the distance detection sensor 131 in the lactation supply device 1 to the control device 4, the control device 4 starts the motor driver 18 in the lactation supply device 1, the motor driver 18 drives the output shaft 141 of the motor 14 to rotate clockwise, the output shaft 141 of the motor 14 drives the screw 16 to rotate clockwise through the shaft sleeve 15, the screw sleeve 17 at the front end of the screw 16 can move linearly and leftward due to the clockwise rotation of the screw 16, so that the screw sleeve 17 pushes the pushing plate 124 to move linearly and leftward, the pushing plate 124 drives the pushing rod 123 to move linearly and leftward, the pushing rod 123 drives the piston 122 to move linearly and leftward in the sleeve 121, the piston 122 drives the reflecting plate 132 to move linearly and leftward in the sleeve 121, the piston 122 uniformly pushes the residual lactation into the stomach tube 2 from the sleeve 121, then the lactation is fed to the premature infant through the stomach tube 2 until the lactation is completely fed, the signal that the lactation is completely fed is transmitted by the lactation supply device 1 to the control device 4, and the lactation supply device 1 is closed by the control device 4, without performing passive lactation supply on the premature infant by the lactation supply device 1.

Finally, the premature infant shall have a rest until the rest stage is ended after the step (3) is finished.

The automatic breastfeeding method of a premature infant and the automatic breastfeeding machine according to the present invention have the following technical effects:

(1) in the active lactation stage, only when the premature infant sucks the detector 3, the detector 3 acquires the sucking action of the premature infant and converts the sucking action into the sucking signal to be transmitted to the control device 4, and the control device 4 starts the lactation supply device 1 to supply lactation to the premature infant after receiving the sucking signal, so that a self-sucking ability of the premature infant is trained, and normal circulation of a mouth-pharyngeal-gastric-intestinal reflex of the premature infant is realized, thus enabling the premature infants to have no difference with term infants in care, diet, neurological development and growth and development in the future;

(2) after the active lactation stage of the premature infant is ended in the step (2), if the residual lactation exists in the lactation supply device 2, the passive lactation stage is performed, and in the passive lactation stage, the control device 4 starts the lactation supply device 1 to uniformly supply the residual lactation to the premature infant through the stomach tube 2, so that nutritional requirements of the premature infant are ensured in the case of taking differences of the premature infants into account; and (3) after the step (3) is finished, the rest stage is performed to enable the premature infant to have enough rest time, which is beneficial to the development of the premature infant.

The foregoing is merely the preferred embodiments of the invention, and it should be noted that those of ordinary skills in the art may further make a plurality of improvements and decorations without departing from the principle of the invention, and these improvements and decorations shall also fall within the protection scope of the invention.

What is claimed is:

1. An automatic breastfeeding method of a premature infant, comprising the following steps of:

step (1) a preparation stage: pre-storing lactation required for nutrition of the premature infant in a lactation supply device; arranging one end of a stomach tube in a stomach of the premature infant, and connecting another end of the stomach tube with the lactation supply device; and arranging a detector in a mouth of the premature infant, electrically connecting the detector with a control device, and electrically connecting the control device with the lactation supply device;

step (2) an active lactation stage: when the premature infant sucks the detector, acquiring, by the detector, a first sucking action of the premature infant, converting the first sucking action into a first signal and transmitting the first signal to the control device, starting the lactation supply device after the control device receives the first signal, and stopping supply of the lactation after the lactation supply device supplies a first certain amount of the lactation to the premature infant through the stomach tube; when the premature infant sucks the detector again, acquiring, by the detector, a second sucking action of the premature infant, converting the second sucking action into a second signal and transmitting the second signal to the control device, starting the lactation supply device after the control device receives the second signal, and stopping supply of the lactation after the lactation supply device supplies a second certain amount of the lactation to the premature infant through the stomach tube; and circulating in such manner until the lactation in the lactation supply device is completely fed or the active lactation stage is ended;

step (3) a passive lactation stage: when the lactation in the lactation supply device is completely fed in the step (2), transmitting a third signal to the control device that indicates that the lactation is completely fed by the lactation supply device, and closing, by the control device, the lactation supply device, without performing passive lactation supply on the premature infant by the lactation supply device; if residual lactation of the lactation is still in the lactation supply device after the active lactation stage ends in the step (2), transmitting, by the lactation supply device, a fourth signal that the residual lactation is still in the lactation supply device to the control device, starting, by the control device, the lactation supply device to uniformly supply the residual lactation of the lactation to the premature infant through the stomach tube until the lactation is completely fed, transmitting, by the lactation supply device, a fifth signal that the lactation is completely fed to the control device, and closing, by the control device, the lactation supply device, without performing passive lactation supply on the premature infant by the lactation supply device; and step (4) a rest stage: letting the premature infant rest until the rest stage is ended after the step (3) is finished.

2. The automatic breastfeeding method of the premature infant according to claim 1, wherein an amount of the lactation required for nutrition of the premature infant pre-stored in the lactation supply device in the step (1) is 5 ml to 60 ml.

3. The automatic breastfeeding method of the premature infant according to claim 1, wherein the active lactation stage in the step (2) lasts for 10 min to 15 min.

4. The automatic breastfeeding method of the premature infant according to claim 1, wherein an amount of the lactation supplied to the premature infant by the lactation supply device in the step (2) is 0.04 ml to 0.06 ml.

5. The automatic breastfeeding method of the premature infant according to claim 1, wherein the passive lactation stage in the step (3) lasts for 5 min to 10 min.

6. The automatic breastfeeding method of the premature infant according to claim 1, wherein a supplying speed of the lactation supply device in the step (3) is 0.4 MI/min to 2 ml/min.

7. The automatic breastfeeding method of the premature infant according to claim 1, wherein the rest stage in the step (4) lasts for 2 h to 3 h.

8. The automatic breastfeeding machine according to claim 1, wherein the lactation supply device comprises a shell, an installation groove arranged in the shell, a propeller fixedly arranged in the installation groove, the propeller comprises a sleeve for storing lactation, a piston, a pushing rod and a pushing plate, an injection head at a front end of the sleeve extending out of the shell and connected with the stomach tube, the piston is slidably arranged in the sleeve, the piston is fixedly connected with a front end of the pushing rod, and a rear end of the pushing rod fixedly connected with the pushing plate; a distance sensing device arranged between a rear end of the piston and a rear end of the sleeve, the distance sensing device comprising a distance detection sensor and a reflecting plate, the reflecting plate fixedly arranged on the piston, the distance detection sensor fixedly arranged on the sleeve, and wherein the distance detection sensor and the reflecting plate are electrically connected with the control device respectively; the lactation supply device further comprising a motor, an output shaft of the motor fixedly connected with a rear end of a screw through a shaft sleeve, a front end of the screw sleeved with a screw sleeve, wherein the screw is in threaded connection with the screw sleeve, and the screw sleeve is fixedly connected with the pushing plate; and the motor is electrically connected with a motor driver, and the motor driver is electrically connected with the control device.

9. The automatic breastfeeding machine according to claim 1, wherein the detector comprises a suction nozzle and a pressure sensor arranged in the suction nozzle, and the pressuresensor is electrically connected with the control device.

* * * * *